United States Patent [19]

Wada et al.

[11] 4,295,780

[45] Oct. 20, 1981

[54] APPARATUS FOR AUTOMATICALLY TRANSFERRING WORKPIECES

[76] Inventors: Yoshimasa Wada, 2411 Ietomi-cho, Ashikaga-shi, Tochigi-ken; Sigeki Yamazaki, 382-36 Oaza-Takabayashi; Isamu Kobayashi, 837 Dainosato, both of Ota-shi, Gunma-ken; Noriyuki Haraguchi, 2-3717 Sakae-cho, Ashikaga-shi, Tochigi-ken; Minoru Fukuda, 1048 Ishihara, Ota-shi, Gunma-ken, all of Japan

[21] Appl. No.: 55,167

[22] Filed: Jul. 6, 1979

[30] Foreign Application Priority Data

Sep. 24, 1978 [JP] Japan ..... 53-117008

[51] Int. Cl.[3] ..... B65G 47/34

[52] U.S. Cl. ..... 414/749; 74/103

[58] Field of Search ..... 414/749, 751, 752, 753; 74/103, 105, 104, 102, 99 R, 110; 221/274

[56] References Cited

FOREIGN PATENT DOCUMENTS 50-107681 8/1975 Japan .

51-87874 7/1976 Japan .

OTHER PUBLICATIONS

Product Engineering Magazine, Oct. 12, 1959, vol. 30, No. 42, "Evan's Linkage".

*Primary Examiner*—David A. Scherbel

[57] ABSTRACT

An apparatus for automatically transferring workpieces which apparatus includes a longer arm of which one end is adapted to be reciprocally moved in the lengthwise direction of the apparatus while the other end is reciprocated in the normal direction, the one end carrying a carriage for workpieces and the other end being guided only in an end portion remote from the path of the one end by a guide, and a pair of shorter arms disposed on opposite sides of and half as long as the longer arm. One end of each shorter arm is pivotally mounted at the center of the length of the longer arm and the other end of each shorter arm is pivotally mounted at a position at the same level as the path of the one end of the longer arm. The shorter arms are adapted to swing through an arc of about 180° from one direction of the path to the opposite direction of the same by a crank mechanism and through a transmission, to thereby effect a highly smooth movement at starting and at stoppage of the carriage as well as an accurate positioning thereof.

4 Claims, 4 Drawing Figures

APPARATUS FOR AUTOMATICALLY TRANSFERRING WORKPIECES

BACKGROUND OF THE INVENTION

The present invention relates to an improved apparatus for transferring workpieces automatically into or out of a press machine.

Conventionally, in this kind of automatic transfer systems, the workpieces to be transferred into the press machine have to be suitably positioned in a feeding station and then mounted on a carriage. Thereafter, the carriage with the workpiece mounted thereon is moved by a pneumatic cylinder or the like to transfer the workpiece into the press machine. However, such a system employing cylinder means for transferring a carriage is affected strongly by inertia forces of the carriage and members associated therewith thereby resulting in inaccurate stopping positions and unstable transfer velocities along the transfer path. Also, such a system is not suitable for a high speed transfer due to its inconsistent movement during the starting and stopping stages. Recently, to improve drawbacks which accompany such conventional systems and to enable a high speed transfer of workpieces, a transfer machine was proposed in laidopen Japanese Pat. No. 107681/1975 published Aug. 25, 1975 in which a Scott-Russell mechanism is employed for transferring a carriage. This type of machine is advantageous in that, as shown in FIG. 4 curve (a) of the drawings attached hereto, an approximate sine-curve is drawn by its speed/location plotting, but this is disadvantageous in that the starting and stopping movements are inconsistent and considerable vibrations and impacts are caused as the foot portions of the sine-curve are not used.

Furthermore, there was also proposed another type of transfer machine, disclosed in laid-open Japanese Pat. No. 87874/1976 published July 31, 1976 which makes use of a crank mechanism and a rotary arm to transfer a carriage through a chain and gears. This type of machines can use a whole sine-curve for its speed characteristics, as shown in FIG. 4, curve (b) of the drawings attached hereto which results in a relatively consistent movements of the carriage during the starting and stopping stages, but on the other hand is accompanied by a serious drawback of inaccurate stop positions of the carriage due to the inertia forces thereof because relaxation of the chain and backlashes of a series of transmission gears and other mating parts reflect in the entireties thereof to the stop positions.

SUMMARY OF THE INVENTION

Therefore, a main object of the present invention is to provide an apparatus for automatically transferring workpieces which is characterized by extremely consistent movements during the starting and stopping stages thereof as well as by a highly accurate stop positions thereof.

To achieve the above described object of the invention, the present invention provides an apparatus comprising a longer arm, whose one end, on which end a carriage is mounted, is adapted to reciprocally move in the lengthwise direction of the apparatus while the other end of which is adapted to reciprocate in the direction perpendicular to the movement direction of the one end, and a pair of shorter arms having a length equivalent to one half of the length of the longer arm and disposed in each side of the longer arm, one end of each shorter arm being pivotally mounted on the longer arm at the midpoint thereof and the other end of each shorter arm being pivotally located at each side of a crossing point of the movement path of the one end of the longer arm and the movement path of the other end of the longer arm, the shorter arms being pivotally swingable about said other end thereof through an arc of up to about 180°, thereby at either one of the stroke ends of the carriage allowing the longer and shorter arms to locate together in the same direction and in a common plane.

BRIEF DESCRIPTION OF THE DRAWINGS

In the detailed description of the preferred embodiments of the present invention set forth below, reference is made to the accompanying drawings in which.

DESCRIPTION OF THE PREFERRED EMBODIMENTS

Figure 1:
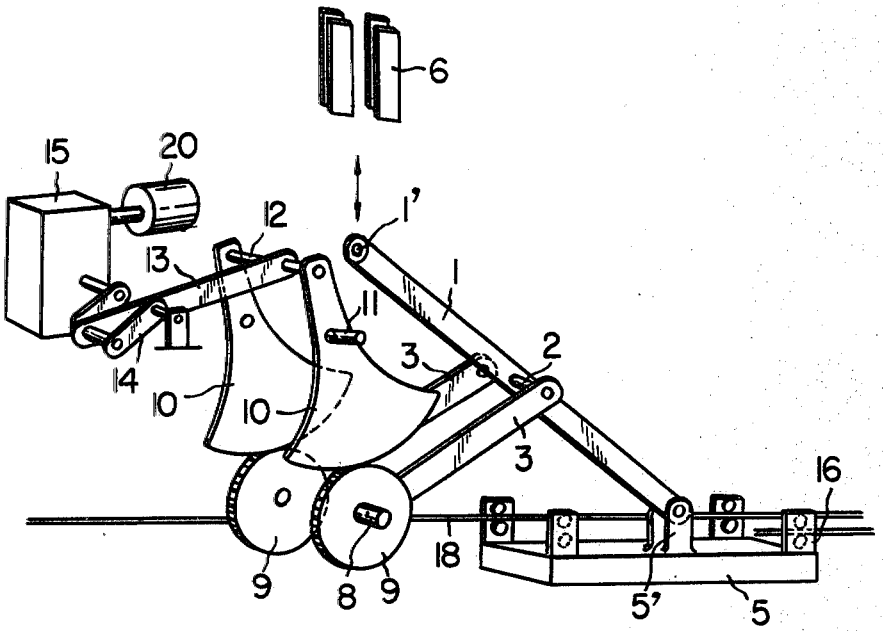
FIG. 1 is a schematic perspective view of an apparatus for automatically transferring workpieces according to an embodiment of the present invention.
Figure 2:
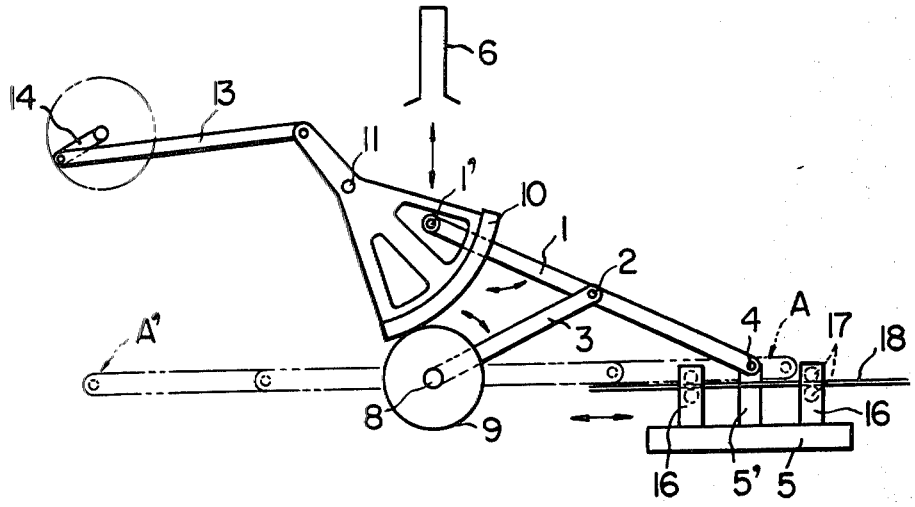
FIG. 2 is a side elevational view of the apparatus shown in FIG. 1.
Figure 3:
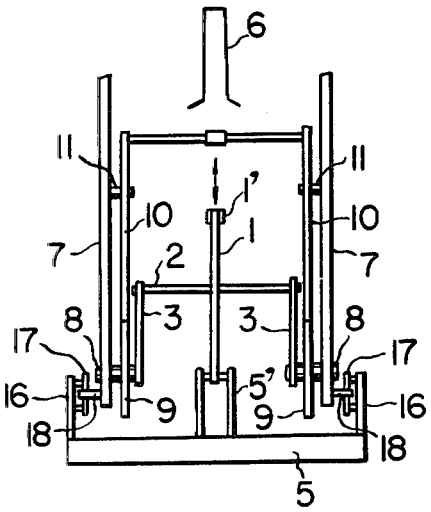
FIG. 3 is a front elevational view of the apparatus shown in FIG. 1.

Referring now to FIGS. 1, 2 and 3, there is shown a horizontally mounted apparatus for automatically transferring workpieces according to the present invention. The apparatus includes a pivotably movable, relatively long arm 1, and a pair of relatively short arms 3 disposed on each side of the arm 1, the upper end of each short arm 3 being pivotally mounted on the longer arm 1 at the midpoint thereof by a rod 2 extending therethrough. The other or lower end of each short arm 3 being pivotally mounted as a center of swinging motion thereof. The lower end of the long arm 1 is pivotally mounted on a support arm 5' of a carriage 5 by means of a pin 4 (FIG. 2). It will be understood that the carriage 5 is adapted to support a workpiece by a suitable holding means such as a vacuum disk or a gripper. Reference numeral 6 in FIGS. 2 and 3 schematically designates a guide which serves to guide the upper end 1' of the arm 1 only when the lower end of the arm 1 travels in the vicinity of the possible closest position to the lower ends of the short arms 3. In other words, only when the upper end of the arm 1 is located at an elevated level in the drawings. The lower end of each short arm 3 is pivotally connected to a respective short rod 8 which is, in turn, supported by a support frame 7 as shown in FIG. 3. The rods 8 serve as a center of the swing motion of the respective arms 3. To each rod 8 is fixedly secured a gear 9 which is adapted to be rotated together with each respective short arm 3. As shown in FIG. 2, each rod 8 is positioned in its respective side of the guide 6 and right below the guide 6, as well as in the travelling path of the lower end of the long arm 1, and more particularly in the path of pin 4 mounted thereon. In addition, each arm 3 has a length that is approximately equal to one half of the length of the long arm 1. Furthermore, and more specifically, the distance between each rod 8 and the rod 2 is one half of the distance between the pin 4 of the long arm 1 and the center of the upper end 1' to be guided, and is equal to the distance between the rod 2 and the pin 4. In each side of the guide 6 is formed a cut-out portion so as to allow free movements of the long arm 1 therein.

Also, in this embodiment, there are provided a pair of sector gears 10 which engage with their respective gears 9, each sector gear 10 being pivotally mounted on a respective pin 11 provided on the support frame 7. These sector gears 10 are interconnected by a rod 12. The rod 12 is coupled to a connector rod 13 at a suitable position. Thus, the respective sector gears 10 are coupled, via the connector rod 13, to a crank mechanism 14 contained in this system. In this respect, as a transmission means adapted to transfer a motion of the crank mechanism 14 to the short arms 3, it is preferable to employ a system including such gears 9 and sector gears 10 as described herein because of compactness and smooth transmission. However, it should be noted that other transmission means may be employed. This crank mechanism 14 is driven via a reduction gear device 15 and by an electric motor 20 which is preferably a D.C. electric motor. The use of such a D.C. motor permits the omission of a clutch brake and is advantageous for maintenance as well as quick return motion without need for a specific mechanism therefor.

In order to guide the carriage 5, the apparatus of this embodiment has upright members 16 secured to each side of the carriage 5. Each upright member 16 is provided with a plurality of rollers 17 which are adapted to hold therebetween their respective guide plate 18 fixedly secured lengthwise to the frame 7 in order to guide the carriage 5. Normally, such an apparatus is positioned in each side of a press machine, one being adapted for insertion of workpieces and the other for discharging the workpieces from the machine.

In operation, the motion of the crank mechanism 14 is transferred to the short arms 3 via a suitable transmission device, for example, through a system including the connector rod 13, sector gears 10 and gears 9, as shown in this embodiment. The arms 3 are swung about the rod 8. The swinging motion of the arms 3 causes lengthwise linear, reciprocal movements of the lower end of the long arm 1 and the carriage 5 secured thereto. At the same time, the upper end of long arm 1 moves vertically and is smoothly guided within the guide 6 only when it is located in its upper positions, but otherwise its movements are not restrained by the guide 6. In the apparatus, during a half cycle of the crank mechanism 14, that is, with one stroke thereof, the arms 3 swing about the lower ends thereof approximately 180° from a direction corresponding to the path of the lower end of the long arm 1 to the opposite direction thereof.

Therefore, at the end of each stroke, as shown in phantom lines denoted by A or A' in FIG. 2, both the long arm 1 and the short arms 3 lie lengthwise in the same direction and in a common plane. On the other hand, a Scott-Russell mechanism would have a guide bar pivotally mounted on the upper end of the long arm 1. The guide bar is guided within a guide and accordingly the long arm 1 cannot be disposed lengthwise due to the restraint of the guide bar. In the apparatus of the present invention, because of the deletion of such a guide bar, the upper end of long arm 1 is not restrained in its lower position, thereby enabling the long arm 1 to be disposed lengthwise at each stroke end.

Figure 4:
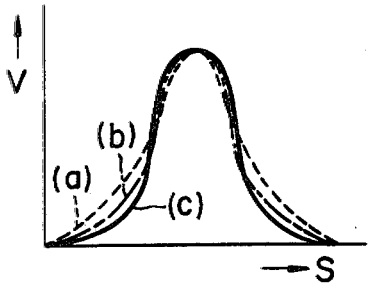
FIG. 4 is a diagram showing velocity characteristics of the apparatus according to the present invention and relevant prior art.

Thus, according to the present invention, as both the long arm 1 and the short arms 3 are disposed in the same direction and in a common plane at each stroke end of the carriage 5, impacts due to the inertia force of the carriage 5 at each stoppage is received by the rods 8 on which the short arms 3 are pivotally mounted. Accordingly, the remaining transmission members are not affected by such impacts and the system is substantially free of backlash effects. A highly accurate positioning of the carriage is thus achieved. For example, while a prior art apparatus has a stopping position accuracy of ±10 mm, an apparatus of this invention has a stopping position accuracy in the range of ±0.5 mm. Since the relatively long arm 1 can be disposed lengthwise at each stroke end, a velocity curve of the carriage 5 extends over the entire portion of a composite sine curve, including both the foot portions thereof. In addition, this velocity curve reflects the velocity characteristics of the crank mechanism 14 as well as the velocity characteristics of the Scott-Russell mechanism, namely being faster in the central portion of the travelling path and becoming slower toward the both ends thereof which are transmitted to the lower end of long arm 1. The lower end of the long arm 1, that is, the carriage 5 is reciprocally moved with a desirable velocity characteristics of a composite sine curve, as shown in a solid line (c) in FIG. 4, which curve has longer foot portions to thereby allow extremely smooth starting and stopping motions of the carriage 5.

The short arms 3 may be designed to swing in an angular range slightly more than 180°, to thereby render the stopping time of the carriage 5 at each stroke end slightly longer. This is convenient to allow some work at each stroke end.

Therefore, according to the present invention, there is caused extremely little impact at each starting or stopping stage thereby enabling highly smooth carriage movements and accurate positioning thereof. Thus, the apparatus of this invention is very useful for high speed operation and also its mechanism is relatively simple and compact.

The present invention may be embodied in other forms or carried out in other ways without departing from the spirit or essential characteristics thereof. For example, the apparatus may be disposed on a slant or upside down. The above embodiment shall therefore be construed as being illustrative and not restrictive. The scope of the invention will be defined by the appended claims, and any changes which fall within the meaning and range of equivalency are intended to be embraced therein.

What we claim as new and desire to secure by United States Letters Patent is:

1. An apparatus for automatically transferring workpieces, said apparatus comprising;
   - a long arm having a first end that is adapted to reciprocally move in the lengthwise direction of the apparatus and a second end which is adapted to reciprocate in a direction perpendicular to the movement direction of said first end;
   - a carriage mounted on said first end for movement together therewith;
   - a guide for engaging and guiding said second end of said long arm only in an end position thereof remote from the path of said first end;
   - a pair of short arms having a length equal to one half of the length of said long arm and disposed in each side of said long arm, one end of each said short arm being pivotally mounted on said long arm at the midpoint thereof and the other end of each said short arm being pivotally located at each side of a crossing point of the movement path of said first end of said long arm and the movement path of said second end of said long arm; and a combination crank mechanism and transmission means adapted to oscillate each said short arm about said other end thereof, the second end of said long arm being adapted to move out of engagement with said guide in order to oscillate each said short arm in an angular range up to about 180° from one direction of the movement path of said first end of said long arm to the opposite direction of the same by means of said crank mechanism, both said long arm and said short arms being disposed in the same direction and in a common plane at each stroke end to thereby enable highly smooth carriage movements and accurate positioning thereof at each stroke end.

2. The apparatus set forth in claim 1, wherein each said short arm is reciprocally swingable in an angular range of slightly more than 180°.

3. The apparatus set forth in claim 1, wherein said crank mechanism is driven by a D.C. electric motor.

4. The apparatus set forth in claim 1, wherein said transmission means includes a pair of sector gears coupled to a connector rod connected to said crank mechanism, and a pair of gears mating with said respective sector gears and secured to the respective other ends of said short arms.

* * * * *